US008626026B2

(12) United States Patent
Yoshikawa

(10) Patent No.: US 8,626,026 B2
(45) Date of Patent: Jan. 7, 2014

(54) IMAGE FORMING DEVICE PROVIDED WITH EASILY REMOVABLE AND REPLACEABLE SECONDARY TRANSFER ROLLER

(75) Inventor: Masanari Yoshikawa, Nagoya (JP)

(73) Assignee: Brother Kogyo Kabushkiki Kaisha, Nagoya-shi, Aichi-ken (JP)

( * ) Notice: Subject to any disclaimer, the term of this patent is extended or adjusted under 35 U.S.C. 154(b) by 113 days.

(21) Appl. No.: 13/413,757

(22) Filed: Mar. 7, 2012

(65) Prior Publication Data

US 2013/0051837 A1 Feb. 28, 2013

(30) Foreign Application Priority Data

Aug. 29, 2011 (JP) ..... 2011-185712

(51) Int. Cl.
*G03G 15/08* (2006.01)
*G03G 15/16* (2006.01)

(52) U.S. Cl.
USPC ..... 399/121; 399/101

(58) Field of Classification Search
USPC ..... 399/101, 121, 123, 302, 308
See application file for complete search history.

(56) References Cited

U.S. PATENT DOCUMENTS

| | | | | |
|---|---|---|---|---|
| 5,787,326 | A * | 7/1998 | Ogawa et al. | 399/124 |
| 7,221,895 | B2 * | 5/2007 | Omata et al. | 399/302 |
| 7,616,916 | B2 * | 11/2009 | Hozono et al. | 399/121 |
| 7,899,381 | B2 * | 3/2011 | Chiba et al. | 399/345 |
| 8,010,027 | B2 * | 8/2011 | Hodoshima et al. | 399/313 |
| 8,014,697 | B2 * | 9/2011 | Tetsuro | 399/101 |

FOREIGN PATENT DOCUMENTS

| | | | |
|---|---|---|---|
| JP | 09006146 | A * | 1/1997 |
| JP | 2006-038989 | | 2/2006 |
| JP | 2010-164633 | | 7/2010 |

* cited by examiner

*Primary Examiner* — Robert Beatty
(74) *Attorney, Agent, or Firm* — Banner & Witcoff, Ltd.

(57) ABSTRACT

An image forming device includes: a main casing; a plurality of photosensitive bodies; a first roller; a second roller; an endless belt; a plurality of primary transfer members; a cleaning unit; and a secondary transfer member. The cleaning unit is configured to collect residual toner remaining on the endless belt, and detachable from and attachable to the main casing. The secondary transfer member is provided at the cleaning unit such that the secondary transfer member is detachable from the main casing upon detachment of the cleaning unit from the main casing and attachable to the main casing upon attachment of the cleaning unit to the main casing.

8 Claims, 6 Drawing Sheets

IMAGE FORMING DEVICE PROVIDED WITH EASILY REMOVABLE AND REPLACEABLE SECONDARY TRANSFER ROLLER

CROSS REFERENCE TO RELATED APPLICATION

This application claims priority from Japanese Patent Application No. 2011-185712 filed Aug. 29, 2011. The entire content of the priority application is incorporated herein by reference.

TECHNICAL FIELD

The present invention relates to an intermediate-transfer type image forming device.

BACKGROUND

A conventional intermediate-transfer type image forming device includes a main casing, a plurality of photosensitive drums, an endless belt, a plurality of primary transfer rollers, and a secondary transfer roller. The endless belt is arranged in confrontation with the plurality of photosensitive drums. The plurality of primary transfer rollers is adapted to transfer a toner image formed on each photosensitive drum to the endless belt. The secondary transfer roller is adapted to transfer the toner image transferred onto the endless belt to a sheet of paper. In one such conventional image forming device, the secondary transfer roller is fixed to the main casing. In order to remove the secondary transfer roller from the main casing, a user needs to use a tool.

SUMMARY

However, in one such conventional image forming device, a bias voltage is applied to the secondary transfer roller, thereby increasing a resistance applied to the secondary transfer roller. This causes degradation of transfer accuracy. Therefore, an image forming device having a configuration such that a secondary transfer roller is easily removable and replaceable is desired.

In view of the foregoing, it is an object of the present invention to provide an image forming device capable of easily removing a secondary transfer roller (a secondary transfer member) from a main casing for replacement of the secondary transfer roller.

In order to attain the above and other objects, the present invention provides an image forming device including: a main casing; a plurality of photosensitive bodies; a first roller; a second roller; an endless belt; a plurality of primary transfer members; a cleaning unit; and a secondary transfer member. The plurality of photosensitive bodies is rotatably supported in the main casing and juxtaposed with each other in a juxtaposed direction with a space between neighboring photosensitive bodies. The second roller is spaced apart from the first roller in the juxtaposed direction. The endless belt is in contact with the plurality of photosensitive bodies and stretched around the first roller and the second roller. The endless belt is configured to circulate around the first roller and the second roller in a circulating direction. The plurality of primary transfer members is in confrontation with the plurality of photosensitive bodies interposing the endless belt between the plurality of primary transfer members and the plurality of photosensitive bodies. The cleaning unit is configured to collect residual toner remaining on the endless belt, and detachable from and attachable to the main casing. The secondary transfer member is in confrontation with the first roller interposing the endless belt between the secondary transfer member and the first roller. The secondary transfer member is provided at the cleaning unit such that the secondary transfer member is detachable from the main casing upon detachment of the cleaning unit from the main casing and attachable to the main casing upon attachment of the cleaning unit to the main casing.

BRIEF DESCRIPTION OF THE DRAWINGS

The particular features and advantages of the invention as well as other objects will become apparent from the following description taken in connection with the accompanying drawings, in which.

DETAILED DESCRIPTION

Figure 1:
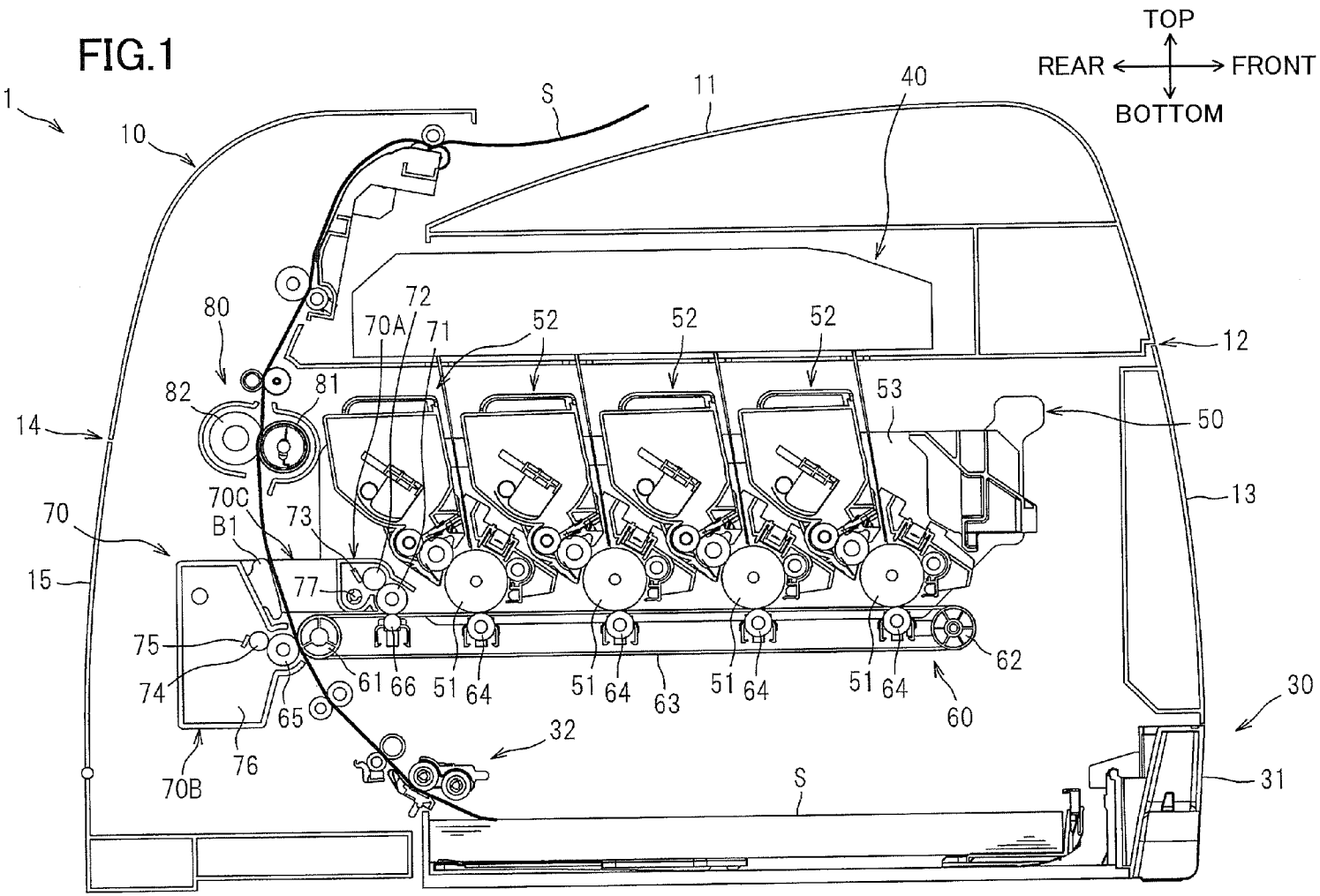
FIG. 1 is a cross-sectional schematic view of a color printer according to one embodiment of the present invention, in which a main casing and a cleaning unit are provided.

Next, a color printer as an image forming device according to one embodiment of the present invention will be described while referring to FIGS. 1 through 4 wherein like parts and components are designated by the same reference numerals to avoid duplicating description.

The terms "upward", "downward", "upper", "lower", "above", "below", "beneath", "right", "left", "front", "rear" and the like will be used throughout the description assuming that the color printer is disposed in an orientation in which it is intended to be used. More specifically, in FIG. 1, a left side and a right side are a rear side and a front side, respectively. Further, in FIG. 1, a near side and a far side are a left side and a right side, respectively.

As shown in FIG. 1, the color printer 1 includes a main casing 10, and, within the main casing 10, a sheet supply unit 30, a scanner unit 40, a drawer 50, a transfer unit 60, a cleaning unit 70, and a fixing device 80.

Figure 2:
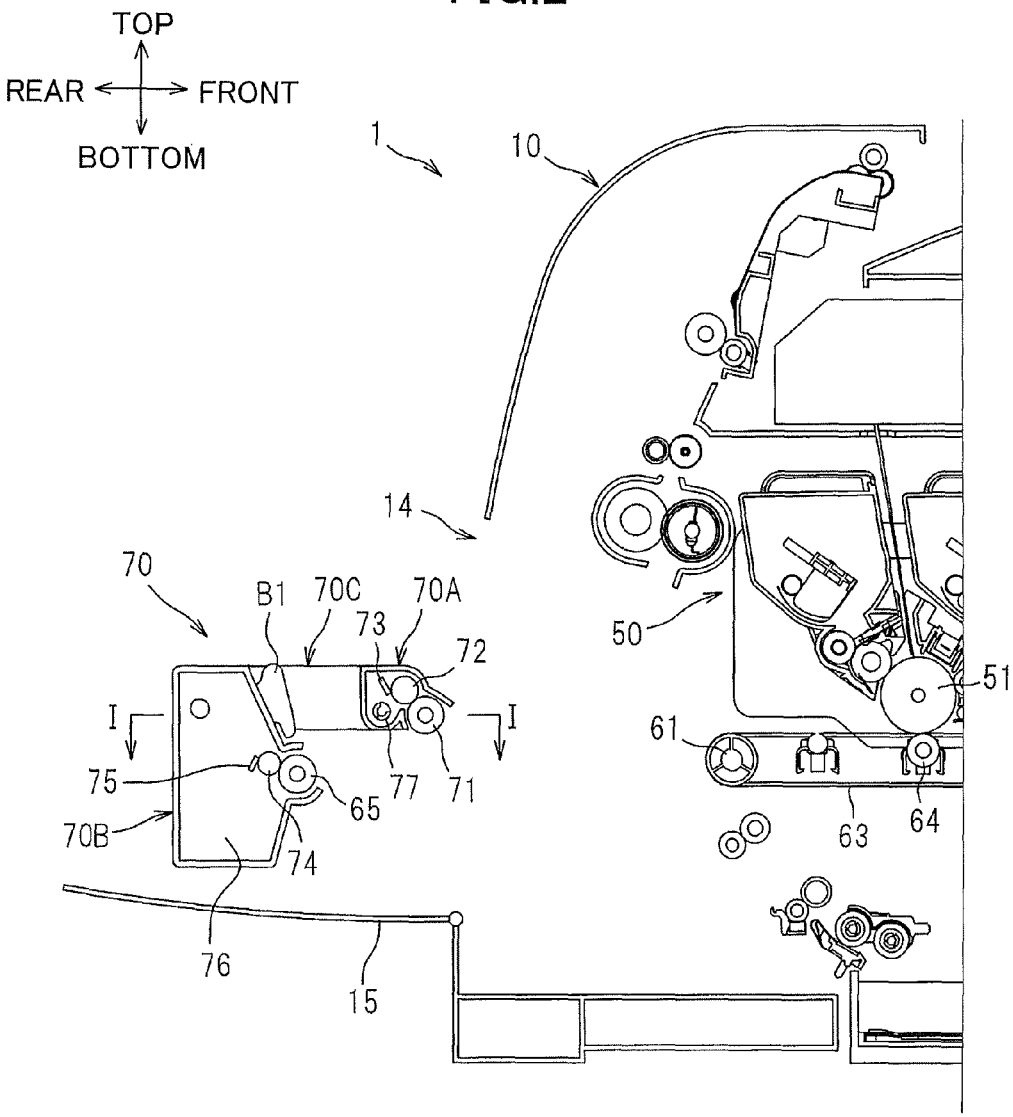
FIG. 2 is a cross-sectional view showing a state in which the cleaning unit has been removed from the main casing.

The main casing 10 has a top portion on which a discharge tray 11 is provided. A sheet S is discharged onto the discharge tray 11 from the main casing 10. Further, the main casing 10 has a front wall formed with an opening 12 for removing the drawer 50 from the main casing 10 and mounting the drawer 50 in the main casing 10. A front cover 13 is provided at the front wall to open and close the opening 12. The front cover 13 is pivotally movable relative to the main casing 10 about a lower end thereof. Further, the main casing 10 has a rear wall formed with an opening 14 for removing the cleaning unit 70 from the main casing 10 and mounting the cleaning unit 70 in the main casing 10. A rear cover 15 is provided at the rear wall to open and close the opening 14. The rear cover 15 is pivotally movable relative to the main casing 10 about a lower end thereof (FIG. 2).

The sheet supply unit 30 is disposed at a lower portion of the main casing 10. The sheet supply unit 30 includes a sheet supply tray 31 and a sheet supply mechanism 32. The sheet supply tray 31 accommodates the sheet S therein. The sheet supply mechanism 32 is adapted to convey the sheet S toward a transfer position (a position between an endless belt 63 and a secondary transfer roller 65) from the sheet supply tray 31. Each sheet S accommodated in the sheet supply tray 31 is conveyed toward the transfer position by the sheet supply mechanism 32.

The scanner unit 40 is disposed at an upper portion of the main casing 10. The scanner unit 40 includes a laser emission unit (not shown), a polygon mirror (not shown), lenses (not shown), and reflection mirrors (not shown). In the scanner unit 40, the laser emission unit irradiates laser beams to expose surfaces of photosensitive drums 51 with high speed scan of the laser beams.

The drawer 50 is disposed above the endless belt 63 and below the scanner unit 40. The drawer 50 is mounted in the main casing 10 and movable relative to the main casing 10 in a frontward/rearward direction. The drawer 50 can be pulled frontward through the opening 12 of the main casing 10. More specifically, the main casing 10 has side plates, each provided with a rail for supporting the drawer 50. Each rail extends in the frontward/rearward direction and has a rear end extending diagonally rearward and downward. When the drawer 50 is pulled outward from the main casing 10, each rail guides the drawer 50 so that the drawer 50 is spaced apart from the endless belt 63. The drawer 50 is movable between an accommodated position inside the main casing 10 and a pulled-out position outside the main casing 10.

The drawer 50 includes four photosensitive drums 51, four chargers (shown without reference numerals), and four developer cartridges 52. The four photosensitive drums 51 are juxtaposed with each other in the frontward/rearward direction with a space between neighboring photosensitive drums 51. The drawer 50 has right and left side walls 53 to which the four photosensitive drums 51 are rotatably supported.

Each developer cartridge 52 is detachably mounted in the drawer 50 and supported to the right and left side walls 53. The developer cartridge 52 includes a well-known developing roller (shown without a reference numeral), a well-known supply roller (shown without a reference numeral), a well-known thickness-regulation blade (shown without a reference numeral), and a well-known toner accommodating portion (shown without a reference numeral).

The transfer unit 60 is disposed below the drawer 50. The transfer unit 60 includes a drive roller 61, a follow roller 62, the endless belt 63, four primary transfer rollers 64, the secondary transfer roller 65, and a backup roller 66. The drive roller 61 and the follow roller 62 are arranged spaced apart from each other in the frontward/rearward direction (a juxtaposed direction that the four photosensitive drums 51 are juxtaposed).

The endless belt 63 is stretched around the drive roller 61 and the follow roller 62 and contacts the four photosensitive drums 51. The four primary transfer rollers 64 are arranged in confrontation with the respective four photosensitive drums 51, interposing a top portion of the endless belt 63 therebetween. The secondary transfer roller 65 is arranged in confrontation with the drive roller 61, interposing a rear portion of the endless belt 63 therebetween. The endless belt 63 circulates in a clockwise direction in FIG. 1 so that the top portion of the endless belt 63 in contact with the four photosensitive drums 51 moves frontward. The backup roller 66 is disposed inside the endless belt 63.

After the surface of the photosensitive drum 51 has been uniformly charged by the corresponding charger, the surface is exposed by the scanner unit 40. An electrostatic latent image based on image data is thereby formed on the surface of the photosensitive drum 51. The toner accommodated in the toner accommodating portion is supplied to a surface of the developing roller via the supply roller.

The toner carried on the surface of the developing roller is supplied to the electrostatic latent image formed on the surface of the photosensitive drum 51. Hence, a visible toner image corresponding to the electrostatic latent image is formed on the surface of the photosensitive drum 51. The toner images in each color carried on the surfaces of the respective photosensitive drums 51 are sequentially transferred onto the endless belt 63 so as to be superimposed on one another. While the sheet S conveyed from the sheet supply unit 30 passes through the transfer position between the endless belt 63 and the secondary transfer roller 65, the toner images carried on the endless belt 63 are transferred onto the sheet S.

The cleaning unit 70 is adapted to collect residual toner remaining on the endless belt 63. More specifically, the cleaning unit 70 collects residual toner not transferred onto the sheet S at the transfer position between the endless belt 63 and the secondary transfer roller 65 and thus remaining on the endless belt 63. The cleaning unit 70 will be described later in detail.

The fixing device 80 is disposed above the cleaning unit 70. The fixing device 80 includes a heat roller 81 and a pressure roller 82. The pressure roller 82 is arranged in confrontation with the heat roller 81 to press the heat roller 81. In the fixing device 80, while the sheet S onto which the toner images are transferred passes between the heat roller 81 and the pressure roller 82, the toner images are thermally fixed onto the sheet S. After the toner images have been fixed onto the sheet S in the fixing device 80, a plurality of discharge roller pairs (shown without reference numerals) conveys the sheet S outward the main casing 10 to discharge the sheet S onto the discharge tray 11.

<Structure of Cleaning Unit>

Next, a structure of the cleaning unit 70 will be described in detail.

Figure 3A:
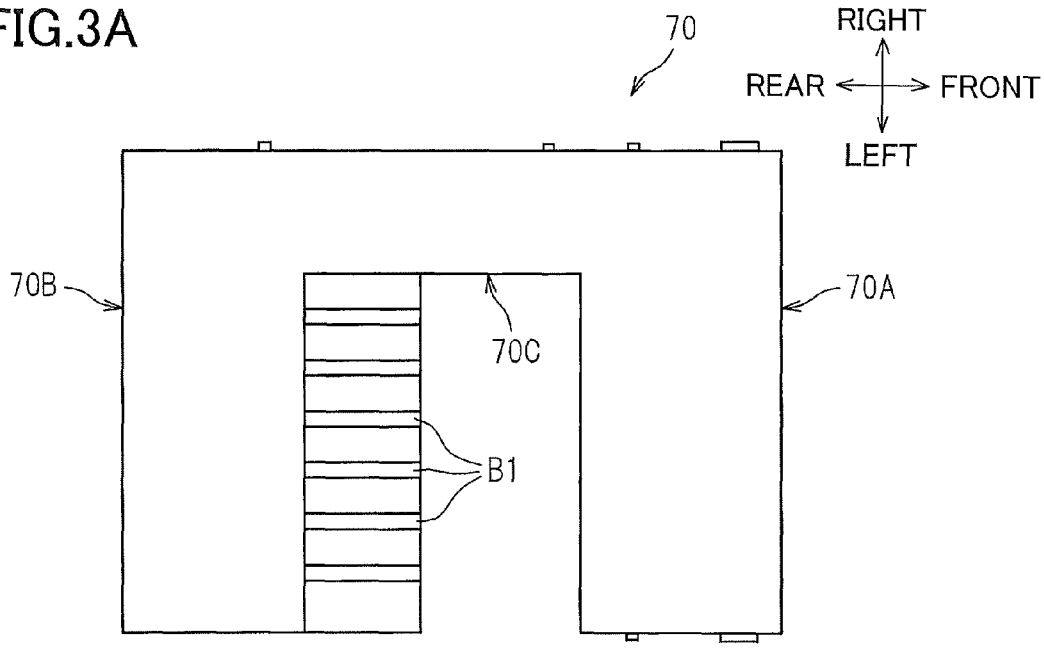
FIG. 3A is a top plan view of the cleaning unit.
Figure 3B:
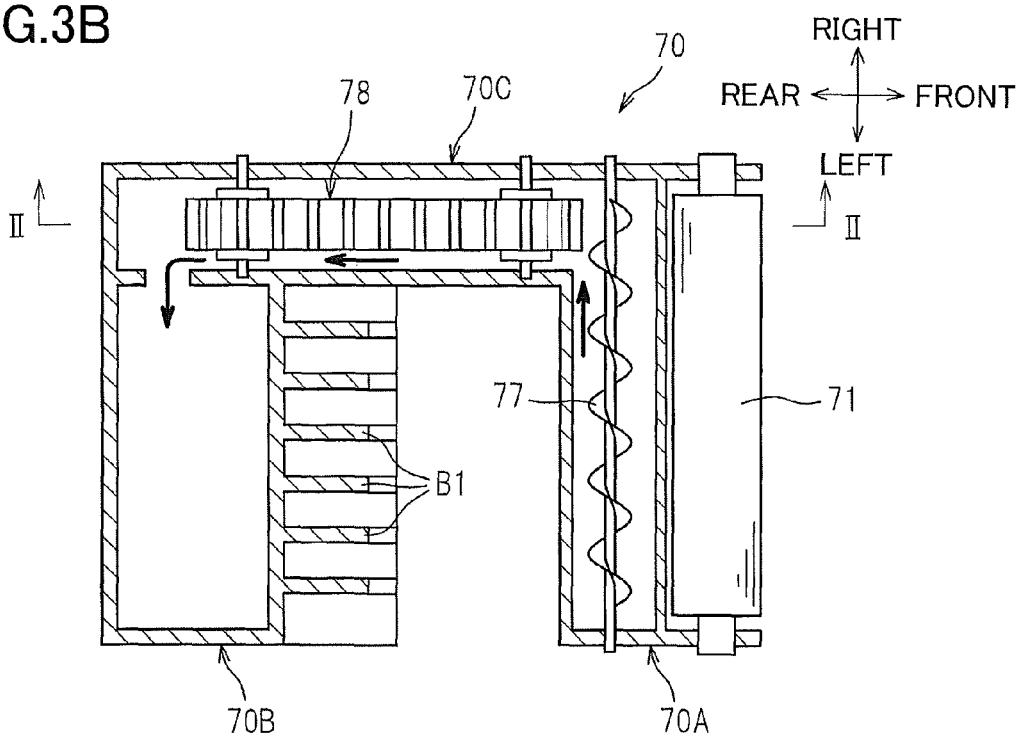
FIG. 3B is a cross-sectional view of the cleaning unit along a line I-I in FIG. 2.

The cleaning unit 70 is integrally provided with a first cleaning roller 71, a collecting roller 72, a first blade 73, the secondary transfer roller 65, a second cleaning roller 74, a second blade 75, a waste toner accommodating portion 76, an auger 77, and a conveying belt 78 (FIG. 3B).

The cleaning unit 70 is directly mounted on the main casing 10. The cleaning unit 70 is detachable from and attachable to right and left side walls of the main casing 10 without using any tools (FIG. 2). The secondary transfer roller 65 constituting a part of the transfer unit 60 is provided integrally with the cleaning unit 70. The secondary transfer roller 65 is detachable from the main casing 10 upon detachment of the cleaning unit 70 from the main casing 10 and attachable to the main casing 10 upon attachment of the cleaning unit 70 to the main casing 10.

With this configuration, the secondary transfer roller 65 can be replaced at the time of replacement of the cleaning unit 70. This configuration facilitates replacement of the secondary transfer roller 65.

The first cleaning roller 71 is arranged so as to interpose the endless belt 63 with the backup roller 66. That is, the first cleaning roller 71 is in contact with an outer peripheral surface of the endless belt 63. The first cleaning roller 71 is positioned downstream of the secondary transfer roller 65 and upstream of the plurality of photosensitive drums 51 in the circulating direction of the endless belt 63. A bias voltage for collecting residual toner is applied across the first cleaning roller 71 and the backup roller 66. Hence, residual toner remaining on the endless belt 63 is captured on the first cleaning roller 71.

The collecting roller 72 rotably contacts the first cleaning roller 71. The collecting roller 72 is adapted to collect the toner carried on the first cleaning roller 71. The toner carried on the collecting roller 72 is scraped off by the first blade 73 arranged in contact with the collecting roller 72.

The second cleaning roller 74 rotatably contacts the secondary transfer roller 65. The second cleaning roller 74 is adapted to collect residual toner carried on the secondary transfer roller 65. The toner carried on the second cleaning roller 74 is scraped off by the second blade 75 arranged in contact with the second cleaning roller 74.

The waste toner accommodating portion 76 is adapted to accommodate residual toner therein. The toner scraped off by the second blade 75 falls down into the waste toner accommodating portion 76 disposed below the second blade 75. The toner scraped off by the first blade 73 also falls down into the waste toner containing portion 76 via a conveyance mechanism such as the auger 77 disposed below the first blade 73. Hence, both of the residual toner collected by the first cleaning roller 71 and the residual toner collected by the second cleaning roller 74 are accommodated in the waste toner accommodating portion 76.

With this configuration, the single waste toner accommodating portion 76 accommodates therein both of the residual toner collected by the first cleaning roller 71 and the residual toner collected by the second cleaning roller 74. In comparison with a case where two waste toner accommodating portions are provided, removal of waste toner is facilitated.

The waste toner accommodating portion 76 is designed so as to have a capacity taking service life of the secondary transfer roller 65 into consideration. When the waste toner accommodating portion 76 is full of residual toner, the secondary transfer roller 65 has been degraded to some extent. Hence, the secondary transfer roller 65 can be replaced at the right time. Unnecessary replacement of the secondary transfer roller 65 can be avoided.

As shown in FIGS. 3A and 3B, the cleaning unit 70 has a first casing 70A, a second casing 70B, and a connecting portion 70C. The first casing 70A and the second casing 70B are arranged in confrontation with and spaced apart from each other in the frontward/rearward direction. The connecting portion 70C connects the first casing 70A and the second casing 70B.

The first casing 70A is formed in a generally rectangular parallelepiped shape and elongated in the rightward/leftward direction. The first casing 70A defines an internal space in which the first cleaning roller 71, the collecting roller 72, the first blade 73, and the auger 77 are disposed (FIG. 2). The auger 77 is adapted to convey collected residual toner in the rightward/leftward direction. The toner is conveyed rightward (toward the connecting portion 70C) from a left side of the first casing 70A.

The second casing 70B is formed in a generally rectangular parallelepiped shape and elongated in the rightward/leftward direction (FIG. 2). The second casing 70B has a vertical length greater than that of the first casing 70A. The second casing 70B defines an internal space in which the secondary transfer roller 65, the second cleaning roller 74, and the second blade 75 are disposed. The waste toner accommodating portion 76 constitutes a bottom section of the second casing 70B.

Figure 4:
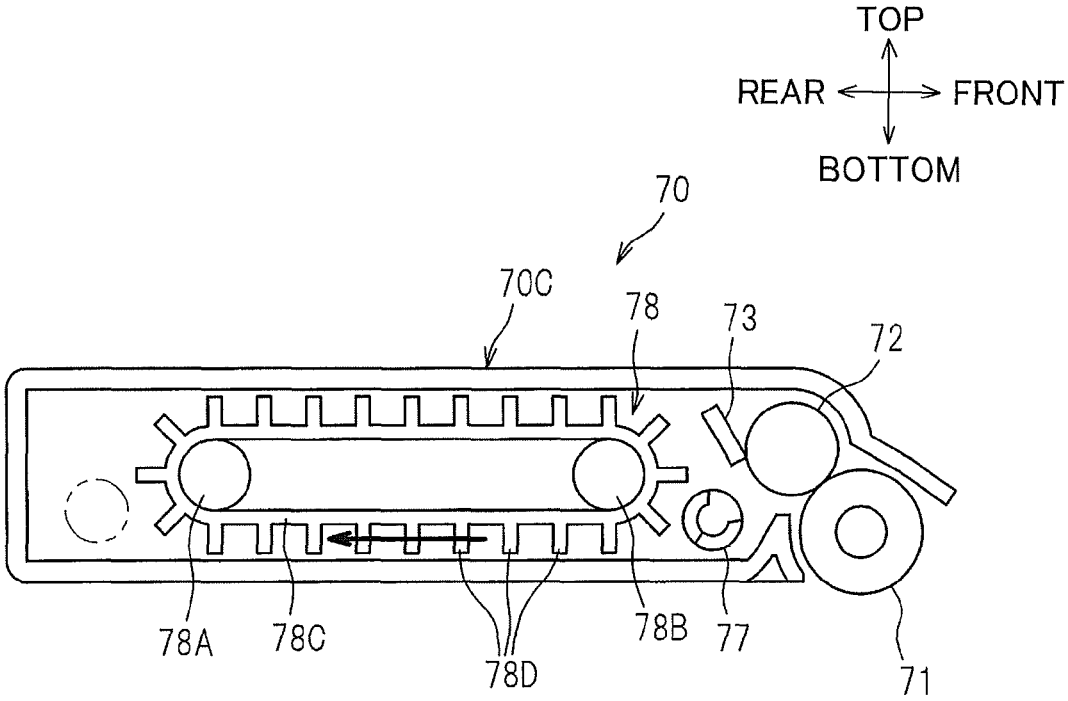
FIG. 4 is a cross-sectional view of the cleaning unit along a line II-II in FIG. 3B.

The connecting portion 70C has a front portion connected to a right portion of the first casing 70A and a rear portion connected to a right portion of the second casing 70B. The connecting portion 70C defines an internal space in communication with the internal space of the first casing 70A as well as the internal space of the second casing 70B. The conveying belt 78 is disposed in the internal space of the connecting portion 70C, as shown in FIGS. 3B and 4. The conveying belt 78 is adapted to convey toner from the first casing 70A side to the second casing 70B side.

The conveying belt 78 includes a pair of rollers 78A, 78B, an endless belt 78C stretched around the pair of rollers 78A, 78B, and a plurality of protrusions 78D protruding outward from the endless belt 78C. With this configuration, as the conveying belt 78 circulates, the plurality of protrusions 78D capture toner to convey the toner rearward.

A drive source (not shown) such as a motor is provided in the main casing 10. The auger 77, each roller of the cleaning unit 70 (for example, the first cleaning roller 71), and at least one of the pair of rollers 78A, 78B are connected to the drive source via gears (not shown), so that a drive force from the drive source is transmitted thereto for rotating the same.

Further, as shown in FIGS. 2, 3A, and 3B, the second casing 70B has a front portion provided with a plurality of guide ribs B1 at an upper portion thereof. More specifically, the plurality of guide ribs B1 is positioned between the first casing 70A and the second casing 70B. The plurality of guide ribs B1 is adapted to guide the sheet S conveyed between the endless belt 63 and the secondary transfer roller 65. The sheet S is guided by the plurality of guide ribs B1 to be conveyed at a downstream side in a sheet conveying direction.

Further, when the sheet S is jammed around the plurality of guide ribs B1, the jam can be cleared by removing the cleaning unit 70 from the main casing 10. More specifically, the first casing 70A and the connecting portion 70C form an L-shape, and the jammed sheet S can be caught by the L-shaped portion to be easily removed out of the main casing 10.

Various modifications are conceivable.

Figure 5:
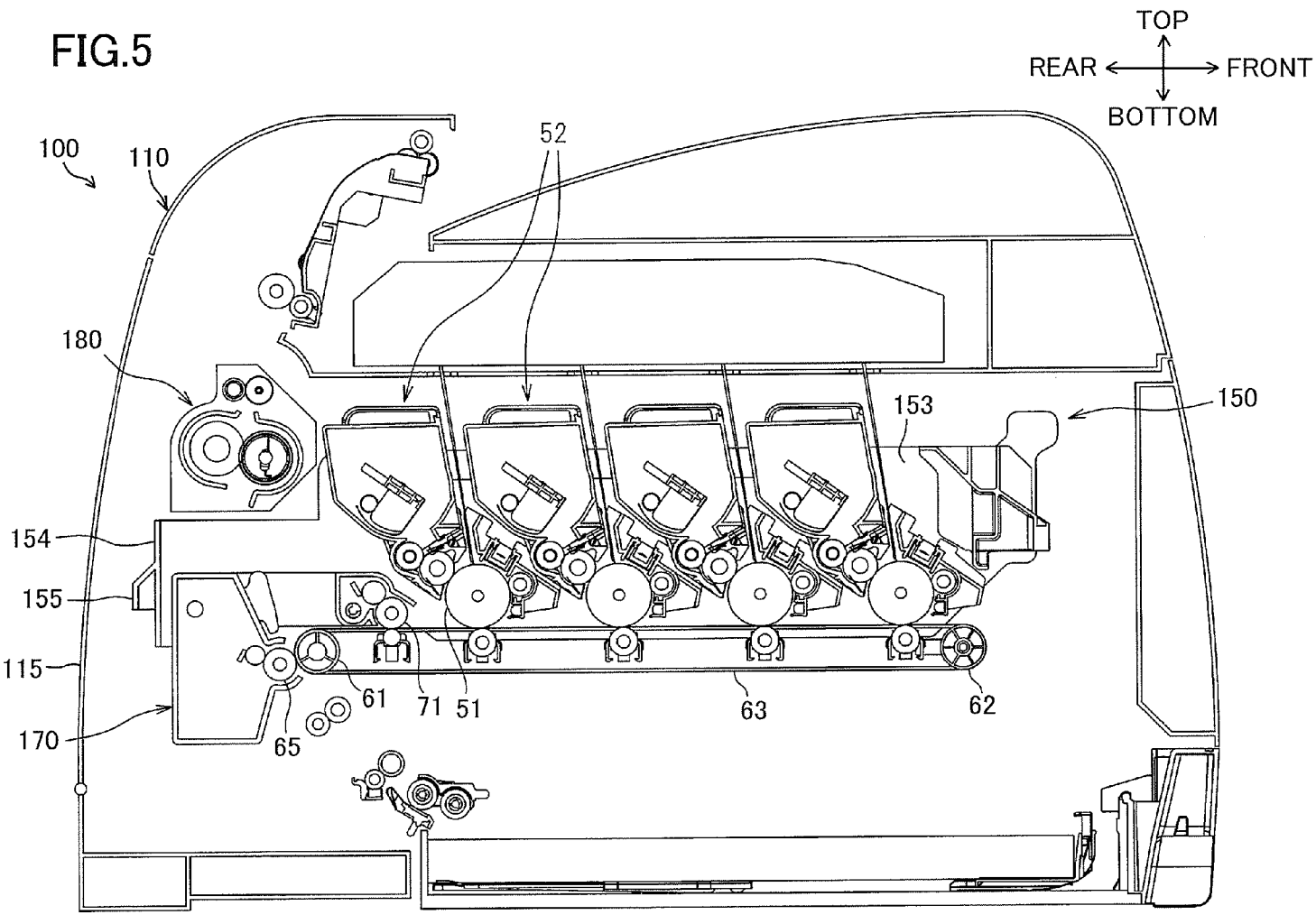
FIG. 5 is a cross-sectional schematic view of a color printer according to one modification of the present invention, in which a cleaning unit is provided integrally with a drawer.
Figure 6:
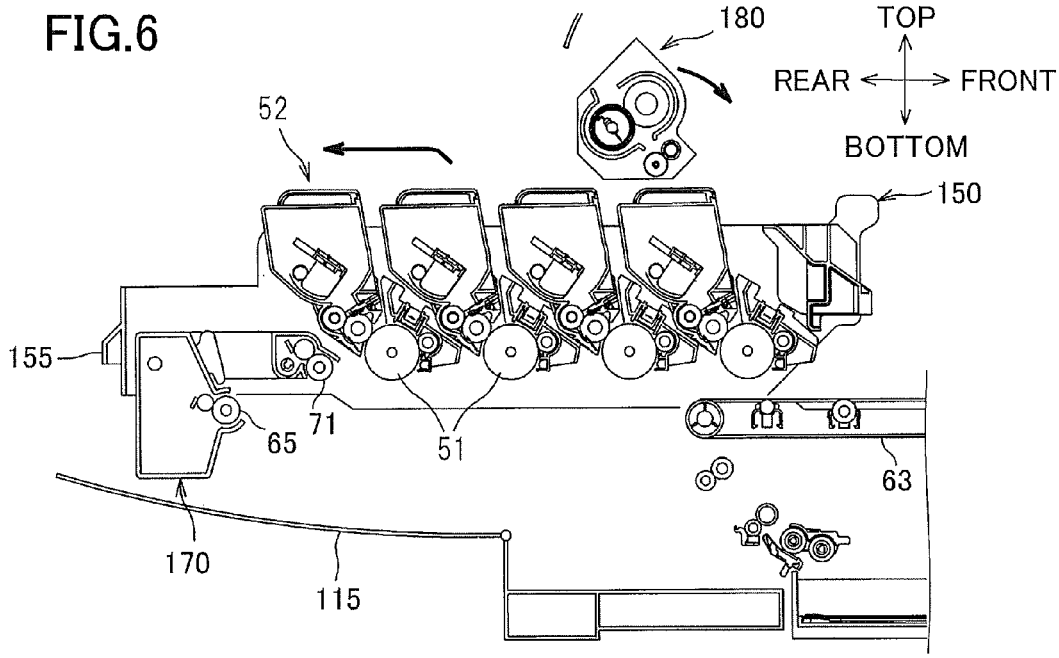
FIG. 6 is a cross-sectional view showing a state in which the drawer has been pulled outward from a main casing of the color printer according to the one modification.

A color printer 100 as an image forming device according to a first modification of the present invention will be described while referring to FIGS. 5 through 7. In the following description, only parts differing from those of the above-described embodiment will be described.

In the above-described embodiment, the cleaning unit 70 is directly mounted in the main casing 10, and detachable from and attachable to the main casing 10. However, the color printer 100 includes a main casing 110 in which a cleaning unit 170 is detachably mounted in a drawer 150. The cleaning unit 170 is detachable from and attachable to the main casing 110 via the drawer 150.

The drawer 150 is movable between the accommodated position and the pulled-out position and adapted to support the plurality of photosensitive drums 51. The drawer 150 has right and left side walls 153 and a rear wall 154. Each of the right and left side walls 153 extends rearward of the cleaning unit 170 and has a rear end portion connected to the rear wall 154. The rear wall 154 has a rear surface on which a handle 155 is provided. The cleaning unit 170 is disposed at a rear portion of the drawer 150. The cleaning unit 170 is supported to the drawer 150, thereby being supported to the main casing 110 via the drawer 150.

The main casing 110 has a rear cover 115 movable between an open position and a closed position. A user holds the handle 155 to pull the drawer 150 rearward, thereby removing the drawer 150 from the main casing 110 through the rear cover 115. Due to the configuration of the drawer 150, the drawer 150 cannot be pulled outward from the main casing 110 through the front cover 13. Therefore, a handle (reference numeral omitted) provided at a front portion of the drawer 150 and the front cover 13 can be dispensed with.

Further, the main casing 110 has side plates, each provided with a rail for supporting the drawer 150. Each rail extends in the frontward/rearward direction and has a front end extending diagonally frontward and downward. With this configuration, when the drawer 150 is at the accommodated position inside the main casing 110 shown in FIG. 5 and pulled outward from the main casing 10, the drawer 150 can be pulled rearward through the rear cover 115 after each photosensitive drums 51 has been separated from the endless belt 63, as shown in FIGS. 6 and 7.

Further, because the drawer 150 is moved upward so as to be spaced away from the endless belt 63 when being pulled outward from the main casing 110, a fixing device 180 is configured to be pivotally movable upward and downward so as not to interfere with the drawer 150. Incidentally, a user may manually move the fixing device 180. Alternatively, the color printer 100 may be provided with an interlocking mechanism for retracting the fixing device 180 upward in interlocking relation to the opening movement of the rear cover 115. Hence, the fixing device 180 may be automatically moved by the interlocking mechanism.

Figure 7:
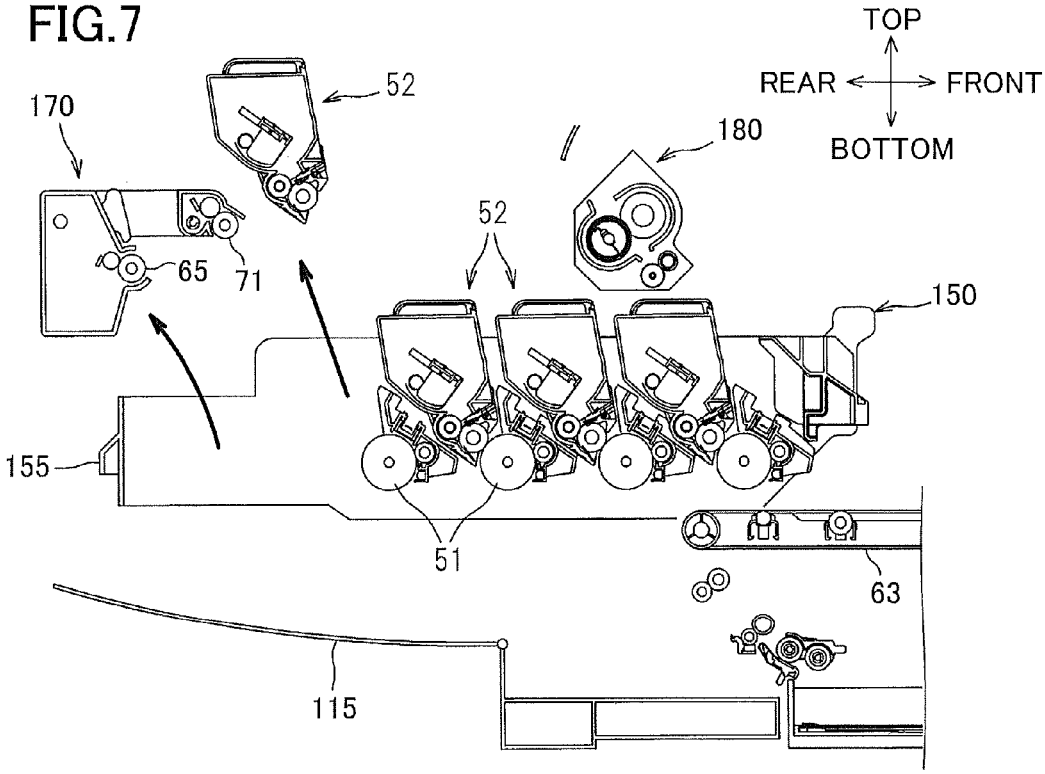
FIG. 7 is a cross-sectional view showing a state in which the cleaning unit has been removed from the drawer according to the one modification.

As shown in FIG. 7, the cleaning unit 170 is detachably mounted in the drawer 150. In comparison with a case where a cleaning unit is fixed to a drawer, it is unnecessary to replace the whole drawer 150 in order to replace the cleaning unit 170. Accordingly, replacement of the cleaning unit 170 can be easily performed.

In the above-described embodiment, the photosensitive drum 51 is employed as a photosensitive body. However, a belt-like photosensitive body is also available.

In the above-described embodiment, the drive roller 61 is a first roller and the follow roller 62 is a second roller. However, the drive roller 61 may be the second roller and the follow roller 62 may be the first roller.

In the above-described embodiment, the primary transfer roller 64 serves as a primary transfer member and the secondary transfer roller 65 serves as a secondary transfer member. However, as the transfer member, an electrically-conductive brush and an electrically-conductive leaf spring plate are also available as far as a transfer bias voltage can be applied thereto.

Further, in the above-described embodiment, a first cleaning member and a second cleaning member are the first cleaning roller 71 and the second cleaning roller 74, respectively. However, as the cleaning member, an electrically-conductive brush and an electrically-conductive leaf spring plate are also available as far as a collection bias voltage can be applied thereto.

Further, the sheet S can be an OHP sheet instead of thick paper, a postcard, and thin paper.

Further, in the above-described embodiment, the image forming device is the color printer. However, any image forming devices other than the color printer, such as a copying machine and a multifunction device, are also available.

While the present invention has been described in detail with reference to the embodiment thereof, it would be apparent to those skilled in the art that various changes and modifications may be made therein without departing from the spirit of the invention.

What is claimed is:

1. An image forming device comprising:

a main casing;

a plurality of photosensitive bodies rotatably supported in the main casing and juxtaposed with each other in a juxtaposed direction with a space between neighboring photosensitive bodies;

a first roller;

a second roller spaced apart from the first roller in the juxtaposed direction;

an endless belt in contact with the plurality of photosensitive bodies and stretched around the first roller and the second roller, the endless belt being configured to circulate around the first roller and the second roller in a circulating direction;

a plurality of primary transfer members in confrontation with the plurality of photosensitive bodies interposing the endless belt between the plurality of primary transfer members and the plurality of photosensitive bodies;

a cleaning unit configured to collect residual toner remaining on the endless belt, and detachable from and attachable to the main casing; and a secondary transfer member in confrontation with the first roller interposing the endless belt between the secondary transfer member and the first roller, the secondary transfer member being provided at the cleaning unit such that the secondary transfer member is detachable from the main casing upon detachment of the cleaning unit from the main casing and attachable to the main casing upon attachment of the cleaning unit to the main casing.

2. The image forming device as claimed in claim 1, wherein the cleaning unit comprises:

a first cleaning member configured to collect residual toner remaining on the endless belt;

a second cleaning member configured to collect residual toner carried on the secondary transfer member; and a waste toner accommodating portion configured to accommodate residual toner therein, wherein the cleaning unit is configured such that the residual toner collected by the first cleaning member and the residual toner collected by the second cleaning member are both accommodated in the waste toner accommodating portion.

3. The image forming device as claimed in claim 2, wherein the endless belt and the secondary transfer member are configured to transfer an image on the endless belt onto a sheet running therebetween; and wherein the cleaning unit further comprises:

a first casing having a first internal space in which the first cleaning member is disposed;

a second casing having a second internal space in which the second transfer member, the second cleaning member, and the waste toner accommodating portion are disposed, the second casing being in confrontation with and spaced apart from the first casing in the juxtaposed direction;

a connecting portion connected to the first casing and the second casing and having a third internal space in communication with the first internal space and the second internal space; and a guide portion disposed between the first casing and the second casing and configured to guide the sheet conveyed between the endless belt and the secondary transfer member.

4. The image forming device as claimed in claim 2, wherein the first cleaning member is positioned downstream of the secondary transfer member and upstream of the plurality of photosensitive bodies in the circulating direction.

5. The image forming device as claimed in claim 1, further comprising a drawer movable between an accommodated position in which the drawer is inside the main casing and a pulled-out position in which at least a part of the drawer is outside the main casing, the drawer being configured to support the plurality of photosensitive bodies, the cleaning unit being supported to the drawer, whereby the cleaning unit is supported to the main casing via the drawer.

6. The image forming device as claimed in claim 5, wherein the cleaning unit is detachably mounted in the drawer, whereby the cleaning unit is detachable from and attachable to the main casing via the drawer.

7. The image forming device as claimed in claim 1, wherein the cleaning unit is directly mounted on the main casing and detachable from and attachable to the main casing.

8. The image forming device as claimed in claim 1, wherein the cleaning unit has a contact portion in contact with the endless belt and positioned downstream of the secondary transfer member and upstream of the plurality of photosensitive bodies in the circulating direction.

* * * * *